US012559218B1

(12) United States Patent
VanRuiswyk et al.

(10) Patent No.: US 12,559,218 B1
(45) Date of Patent: Feb. 24, 2026

(54) LOWER UNIT FOR A MARINE PROPULSION DEVICE

(71) Applicant: Brunswick Corporation, Mettawa, IL (US)

(72) Inventors: Brad J. VanRuiswyk, Waupun, WI (US); Jay P. Dehling, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 433 days.

(21) Appl. No.: 18/190,547

(22) Filed: Mar. 27, 2023

(51) Int. Cl.
*B63H 23/32* (2006.01)
*B63H 23/34* (2006.01)

(52) U.S. Cl.
CPC ..... *B63H 23/321* (2013.01); *B63H 23/34* (2013.01)

(58) Field of Classification Search
CPC ..... B63H 23/321; B63H 23/34
See application file for complete search history.

(56) References Cited

U.S. PATENT DOCUMENTS

| | | | | |
|---|---|---|---|---|
| 7,188,543 | B1 | 3/2007 | Andrews et al. | |
| 10,232,923 | B1 | 3/2019 | Novak et al. | |
| 10,323,721 | B1 | 6/2019 | Smith et al. | |
| 10,752,328 | B1 * | 8/2020 | Bielefeld | B63H 23/02 |
| 11,866,133 | B1 * | 1/2024 | Mueller | B63B 79/10 |

OTHER PUBLICATIONS

Declaration of Prior Art of Brad J. VanRuiswyk and Jay P. Dehling.

* cited by examiner

*Primary Examiner* — Sabbir Hasan
(74) *Attorney, Agent, or Firm* — Andrus Intellectual Property Law, LLP

(57) ABSTRACT

A lower unit for a marine propulsion device comprises a housing having a central bore extending along a longitudinal axis, wherein the central bore at least partially defines an exhaust passageway for travel of exhaust gas from upstream to downstream through the lower unit. A bearing carrier is seated within the central bore and the bearing carrier further defines a portion of the exhaust passageway. A propeller shaft extends along the longitudinal axis and is coaxially supported within the bearing carrier. The lower unit includes an adapter having a convexly curved surface configured to cover an upstream-facing surface of the bearing carrier so as to smooth flow of the exhaust gas into the portion of the exhaust passageway defined by the bearing carrier.

19 Claims, 7 Drawing Sheets

LOWER UNIT FOR A MARINE PROPULSION DEVICE

FIELD

The present disclosure relates to lower units for marine propulsion devices such as marine outboard and inboard/outboard drives.

BACKGROUND

Many marine outboard and inboard/outboard drives having prime movers that create exhaust gas (e.g., as a byproduct of combustion) have an exhaust gas pathway from the prime mover, through intermediate passageways, into a lower unit of the drive, and out a propeller hub of the drive. Such exhaust pathways ensure that gas is exhausted under water while the marine drive is in use, muffling the exhaust noise.

Lower units of inboard and inboard/outboard drives typically include a torpedo housing for supporting a propeller shaft of the drive. A bearing carrier is provided in the torpedo housing to support the propeller shaft. For example, U.S. Pat. No. 7,188,543, which is hereby incorporated by reference herein in its entirety, discloses a subassembly for insertion into a lower unit of a marine drive.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, a lower unit for a marine propulsion device comprises a housing having a central bore extending along a longitudinal axis, wherein the central bore at least partially defines an exhaust passageway for travel of exhaust gas from upstream to downstream through the lower unit. A bearing carrier is seated within the central bore, the bearing carrier comprising a main body and a support ring spaced circumferentially outwardly from the main body and seated against an interior surface of the central bore. The exhaust passageway is further defined by a gap between the main body and the support ring that is configured to allow the exhaust gas to flow therethrough from upstream to downstream. A propeller shaft extends along the longitudinal axis and is coaxially supported within the bearing carrier. An annular adapter is attached to an upstream end of the support ring, the annular adapter being configured to smooth flow of the exhaust gas passing over the annular adapter and into the gap between the main body and the support ring.

According to some aspects, the support ring comprises a circumferential groove and the annular adapter comprises a lip configured to be seated within the groove. Optionally, the groove is located on a radially outwardly facing surface of the support ring.

According to some aspects, the annular adapter comprises a convexly curved upstream surface, a flange configured to be pressed or trapped between a radially outwardly facing surface of the support ring and the interior surface of the central bore, and a radially inwardly projecting lip configured to be seated within a circumferential groove defined in the radially outwardly facing surface of the support ring. Optionally, the circumferential groove has a shallower upstream side and a deeper downstream side, and the flange is dimensioned to fill a space between the shallower upstream side of the groove and the interior surface of the central bore.

According to some aspects, an upstream surface of the annular adapter is convexly curved. Optionally, the upstream surface of the annular adapter is semicircular in cross-section.

According to some aspects, the annular adapter comprises a flange that is configured to be pressed or trapped between a radially outwardly facing surface of the support ring and the interior surface of the central bore.

According to some aspects, the annular adapter comprises two semi-annular components.

According to some aspects, the annular adapter is configured to cover an entirety of the upstream end of the support ring.

According to another example of the present disclosure, a lower unit for a marine propulsion device comprises a housing having a central bore extending along a longitudinal axis, wherein the central bore at least partially defines an exhaust passageway for travel of exhaust gas from upstream to downstream through the lower unit. A bearing carrier is seated within the central bore and the bearing carrier further defines a portion of the exhaust passageway. A propeller shaft extends along the longitudinal axis and is coaxially supported within the bearing carrier. The lower unit includes an adapter having a convexly curved surface configured to cover an upstream-facing surface of the bearing carrier so as to smooth flow of the exhaust gas into the portion of the exhaust passageway defined by the bearing carrier.

According to some aspects, the adapter is an annular adapter, the bearing carrier comprises a circumferential groove, and the annular adapter comprises a lip configured to be seated within the groove in the bearing carrier. Optionally, the groove is located on a radially outwardly facing surface of the bearing carrier.

According to some aspects, the adapter comprises a flange that is configured to be pressed or trapped between a radially outwardly facing surface of the bearing carrier and an interior surface of the central bore. Optionally, the adapter further comprises a radially inwardly projecting lip configured to be seated within a circumferential groove defined in the radially outwardly facing surface of the bearing carrier. Optionally, the circumferential groove has a shallower upstream side and a deeper downstream side, and the flange is dimensioned to fill a space between the shallower upstream side of the groove and the interior surface of the central bore.

According to some aspects, the convexly curved surface of the adapter is semicircular in cross-section.

According to some aspects, the adapter comprises two semi-annular components.

According to some aspects, the adapter is configured to cover an entirety of the upstream-facing surface of the bearing carrier.

According to some aspects, the bearing carrier comprises a main body and a support ring spaced circumferentially outwardly from the main body and seated against an interior surface of the central bore. The portion of the exhaust passageway is defined by a gap between the main body and the support ring, and the upstream-facing surface of the bearing carrier comprises an upstream end of the support ring.

BRIEF DESCRIPTION OF THE DRAWINGS

The present disclosure is described with reference to the following Figures. The same numbers are used throughout the Figures to reference like features and like components.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless otherwise specified or limited, the phrases "at least one of A, B, and C," "one or more of A, B, and C," and the like, are meant to indicate A, or B, or C, or any combination of A, B, and/or C, including combinations with multiple instances of A, B, and/or C. Likewise, unless otherwise specified or limited, the terms "mounted," "connected," "linked," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings.

As used herein, unless otherwise limited or defined, discussion of particular directions is provided by example only, with regard to particular embodiments or relevant illustrations. For example, discussion of "top," "bottom," "front," "back," "left," "right," "lateral" or "longitudinal" features is generally intended as a description only of the orientation of such features relative to a reference frame of a particular example or illustration. Correspondingly, for example, a "top" feature may sometimes be disposed below a "bottom" feature (and so on), in some arrangements or embodiments. Additionally, use of the words "first," "second", "third," etc. is not intended to connote priority or importance, but merely to distinguish one of several similar elements from another.

Figure 1:
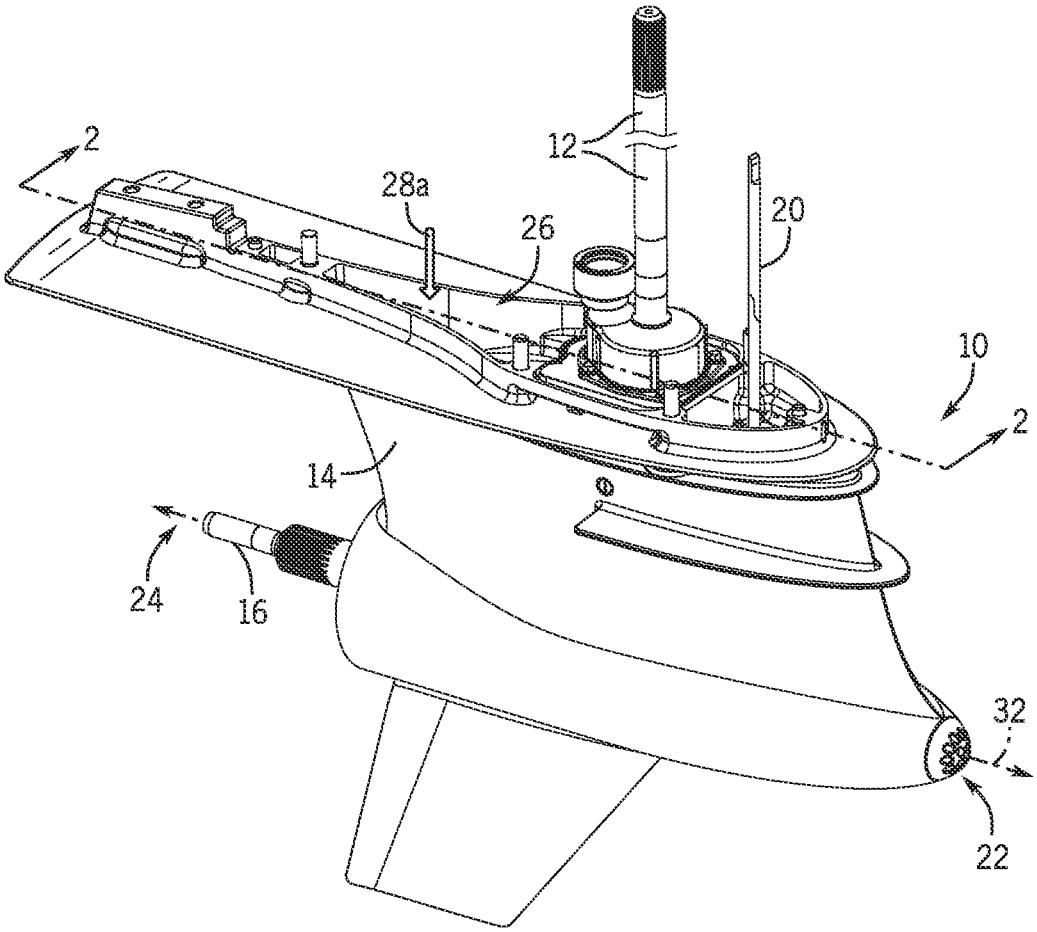
FIG. 1 shows a lower unit according to the present disclosure.
Figure 2:
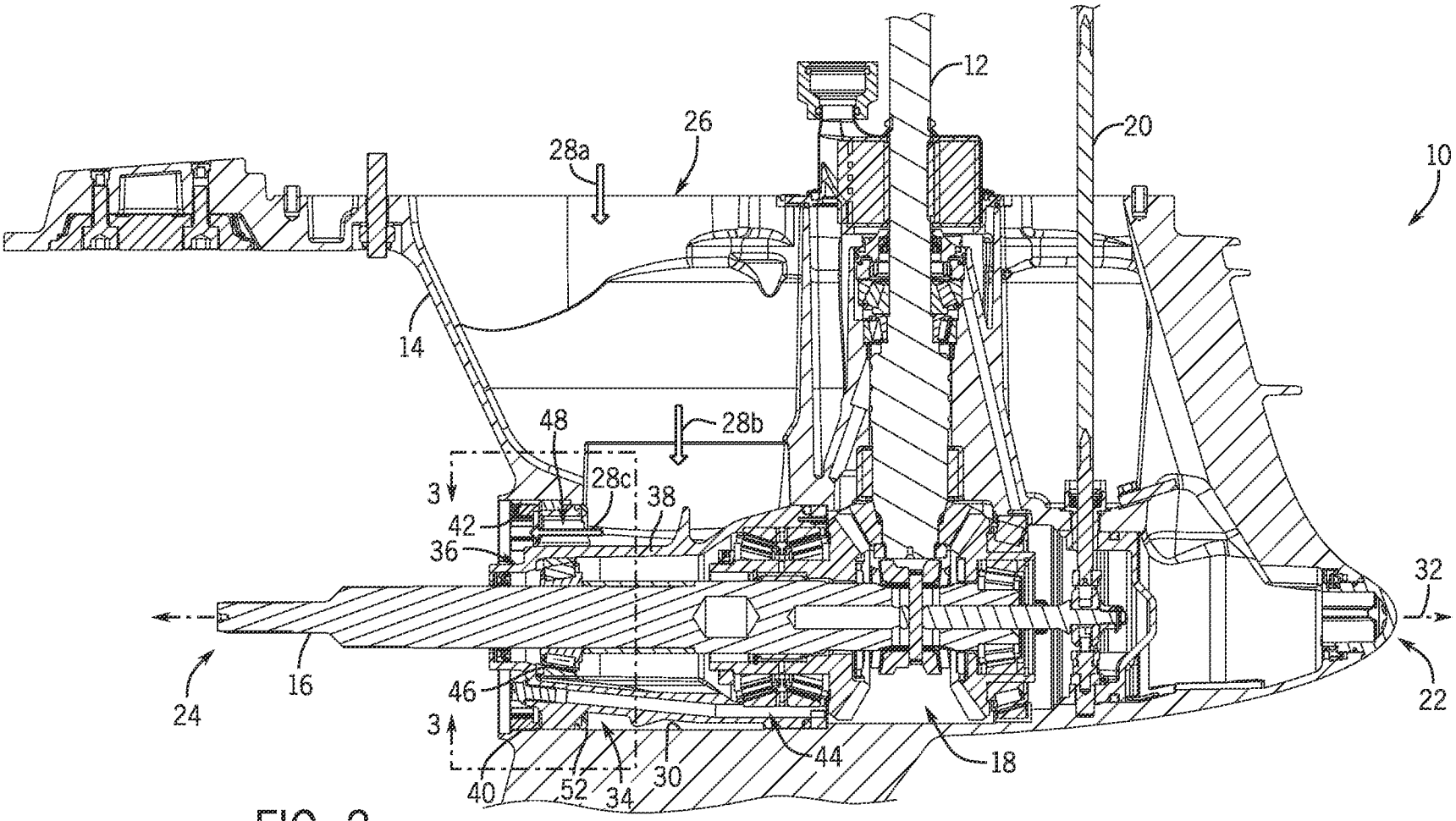
FIG. 2 is a cross section through the lower unit, taken along the line 2-2 in FIG. 1.

FIG. 1 shows a lower unit 10 for a marine propulsion device. In this example, the lower unit 10 is for an outboard drive, but in other examples the lower unit 10 could be for an inboard/outboard drive, such as a stern drive or a pod drive. The lower unit 10 includes a drive shaft 12, which is driven by a prime mover such as an internal combustion engine (not shown). The drive shaft 12 extends downwardly to a lower unit housing 14 (sometimes referred to as a torpedo housing or a gearcase), which is configured to hold a propeller shaft 16. The propeller shaft 16 is in turn configured to support a propeller (not shown). As shown in FIG. 2, the drive shaft 12 and the propeller shaft 16 are coupled by a gear set 18. A shift shaft 20 shifts the gear set 18 between forward, neutral, and reverse gear to couple and decouple the propeller shaft 16 to/from the drive shaft 12 as is conventional. A gear set other than that shown here could be alternatively be provided.

When the lower unit 10 is moving forward through the water, it has an upstream end 22 and a downstream end 24. Water flows past the lower unit 10 from upstream to downstream. As the prime mover operates, it produces exhaust, for example, combustion byproducts. The exhaust gas is routed from the prime mover to the lower unit 10. Specifically, the exhaust gas is routed into the lower unit 10 via an exhaust passageway 26. Exhaust continues through the lower unit 10 and exits via a hub of the propeller (not shown) as is conventional. More specifically, as shown in FIG. 2, the exhaust gas flows through the lower unit 10 as shown by the arrows 28*a* and 28*b* and into a central bore 30 of the housing 14. The central bore 30 extends along a longitudinal axis 32 and at least partially defines an exhaust passageway 34 for travel of exhaust gas from upstream to downstream through the lower unit 10.

Figure 4:
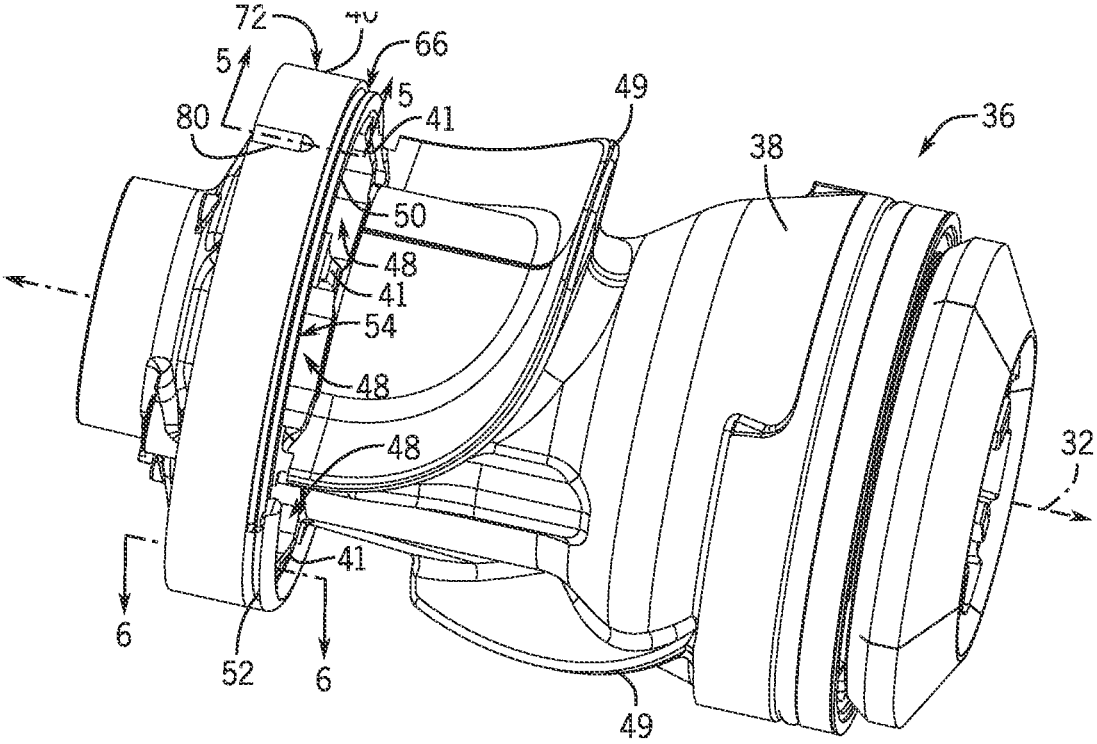
FIG. 4 shows a bearing carrier according to the present disclosure.

A bearing carrier 36 is seated within the central bore 30. Referring to FIGS. 2 and 4, the bearing carrier 36 comprises a main body 38 and a support ring 40 spaced circumferentially outwardly from the main body 38. A plurality of spaced ribs 41 connect the support ring 40 to the main body 38. The support ring 40 is configured to be seated against an interior surface 42 of the central bore 30. The propeller shaft 16 extends along the longitudinal axis 32 and is coaxially supported within the bearing carrier 36 by sets of bearings 44, 46, which facilitate rotation of the propeller shaft 16 within the bearing carrier 36. The bearing carrier 36 may optionally include curved vanes 49, which may help to improve flow of the exhaust gas along and past the bearing carrier 36, thereby increasing efficiency.

Figure 3:
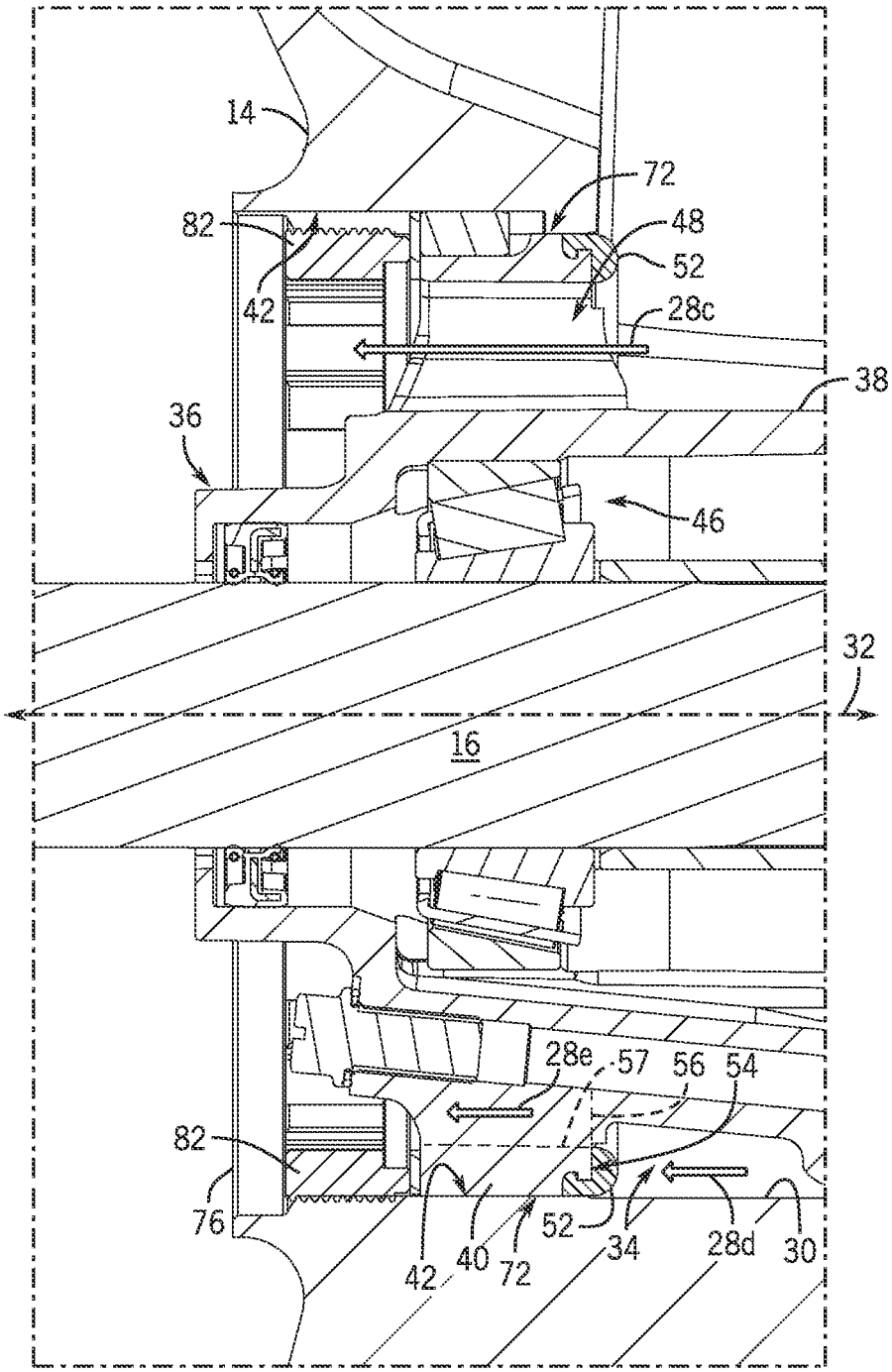
FIG. 3 is a detailed view of a portion of the cross section of FIG. 2.

The exhaust passageway 34 is further defined by a gap 48 between the main body 38 and the support ring 40 that is configured to allow the exhaust gas to flow therethrough from upstream to downstream. More specifically, multiple gaps 48 between each of the ribs 41 connecting the main body 38 and the support ring 40 define part of the exhaust passageway 34. Exhaust gas flows from upstream to downstream through the gaps 48, as shown for example by arrow 28*c* in FIGS. 2 and 3. Note that although a rib 41 is shown in the lower portion of the cross-sectional view of FIG. 3, a gap 48 is defined on either side of the rib 41 as shown by the dashed lines 56, 57, and exhaust gas that flows radially within the bore 30 around the main body 38 of the bearing carrier 36 as shown by the arrow 28*d* is thereby able to flow through the gap 48 between the support ring 40 and the main body 38 as shown at arrow 28*e*. Thereafter, the exhaust gas exits the central bore 30 of the housing 14 and flows through passageways defined in the hub of the propeller, to be exhausted from the aft end of the propeller hub.

A balance between the bearing carrier's ability to support the propeller shaft 16 and the necessity of passing exhaust gas through the bearing carrier 36 to optimize engine performance is required. If the gaps 48 between the main body 38 and the support ring 40 are too small this creates high levels of back pressure, negatively affecting engine performance. Conversely, if the ribs 41 between the main body 38 and the support ring 40 are too thin, the propeller shaft 16 and related components may not be sufficiently supported, resulting in rotational inefficiencies, premature wear of parts, and/or structural failure. Due to the manufacturing process of the bearing carrier 36, there is a sharp corner 50 (FIGS. 4, 5) present on the edges leading into the gaps 48 between the main body 38, support ring 40, and ribs 41 of the bearing carrier 36. Through research and experimentation, the present inventors discovered that one way to increase the efficiency of exhaust gas flowing through the bearing carrier 36 without sacrificing structural requirements was to provide a radius at this otherwise sharp corner 50 at the entrance edges of the gaps 48.

Figure 5:
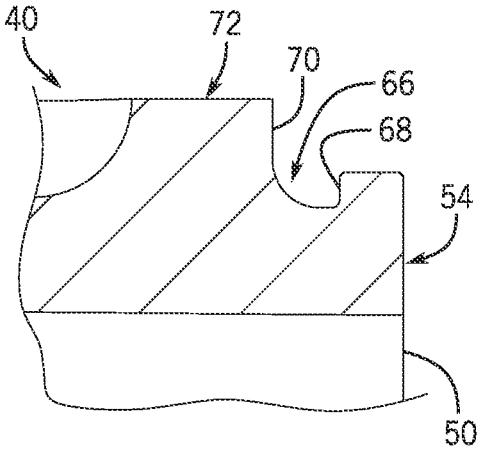
FIG. 5 is a cross section through a portion of the bearing carrier, taken along the line 5-5 in FIG. 4.
Figure 6:
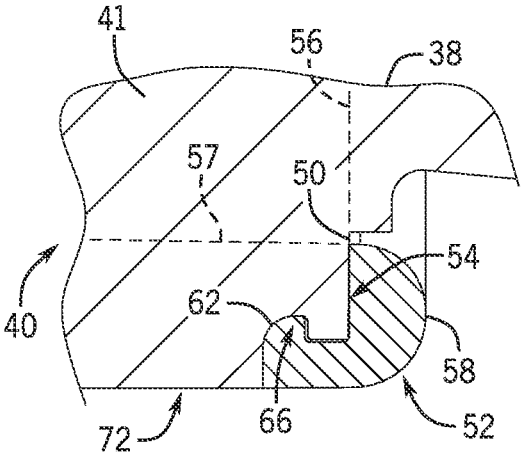
FIG. 6 is a cross section through a portion of the bearing carrier, taken along the line 6-6 in FIG. 4.

To that end, and now referring to FIGS. 3-6, the lower unit 10 of the present disclosure includes an annular adapter 52 attached to an upstream end 54 of the support ring 40, where the exhaust gas enters the gaps 48 between the main body 38, support ring 40, and ribs 41 of the bearing carrier 36. The annular adapter 52 is configured to smooth flow of the exhaust gas passing over the annular adapter 52 and into the gaps 48 between the main body 38 and the support ring 40. FIG. 4 shows the bearing carrier 36 with only a first portion of the annular adapter 52 installed on the lower half of the support ring 40. The upper half of the bearing carrier 36 does not have the annular adapter 52 installed, and thus the upstream end 54 of the support ring 40 is exposed, showing the sharp corner 50 at the entrance edge of the gaps 48. (See FIG. 5, which shows a cross section of this area without the annular adapter 52 installed.) The annular adapter 52 is installed on the bottom half of the bearing carrier 36 and a cross section of this area is shown in FIG. 6. Although the rib 41 is shown in this cross-sectional view, the dashed lines 56 and 57 show where the edge of the upstream end 54 of the support ring 40 is located behind the rib 41. It can be seen that the annular adapter 52 provides a radius to the otherwise sharp corner 50 at this edge.

Figure 7:
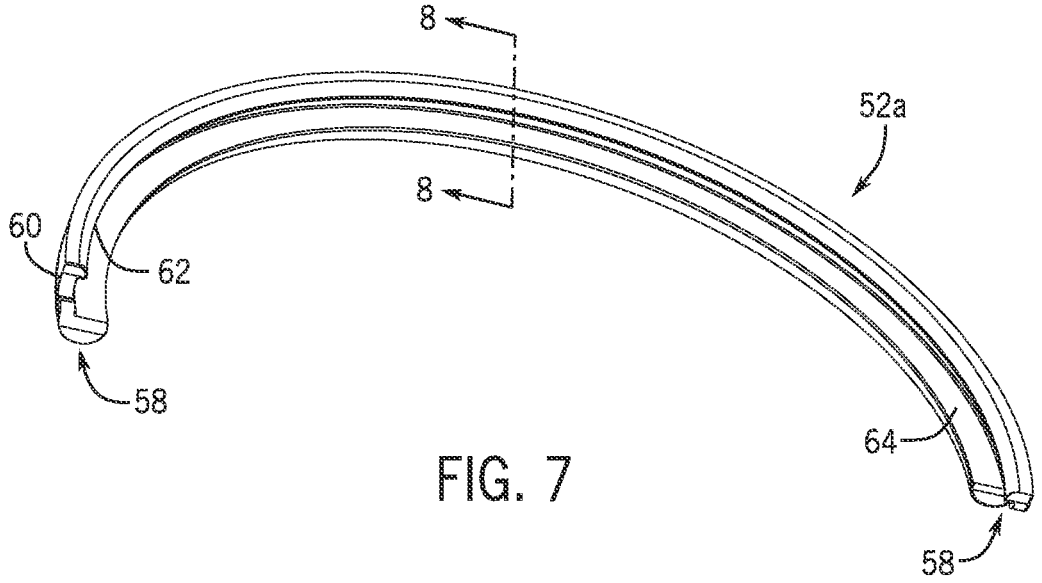
FIG. 7 shows a first component of an adapter for attachment to the bearing carrier.
Figure 8:
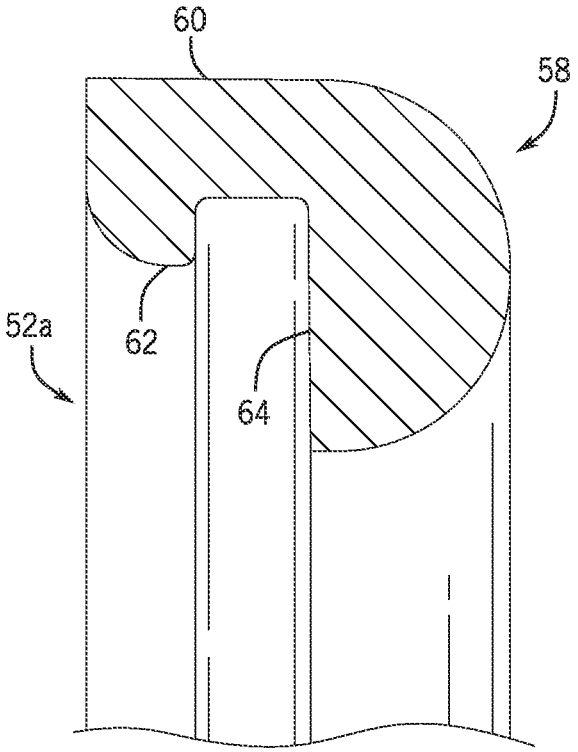
FIG. 8 is a cross section through the adapter, taken along the line 8-8 in FIG. 7.

A component 52*a* of the annular adapter 52 is shown in FIG. 7 and a cross section therethrough is shown in FIG. 8. The annular adapter 52 comprises a convexly curved upstream surface 58. Due to the radius on the annular adapter 52, exhaust gas is guided over the curved upstream surface 58 with less turbulence than would otherwise have been the case were the exhaust gas to pass over the sharp corner 50 at the upstream end 54 of the support ring 40. The flow of exhaust gas is therefore smoother over the curved upstream surface 58 than over the sharp corner 50, resulting in less backpressure upstream toward the prime mover and increased engine efficiency. In the present example, the upstream surface 58 of the annular adapter 52 is semicircular in cross-section. However, in other examples, the upstream surface 58 could be parabolic, semi-elliptical, a simple curve, a complex curve, or another type of curved shape. In still another example, the upstream surface 58 of the annular adapter 52 is curved only along a portion thereof, but is a straight line along another portion thereof. The annular adapter 52 also comprises a flange 60, which extends in the longitudinal downstream direction from the upstream surface 58 and is configured to encircle the outer circumference of the support ring 40. The annular adapter 52 further comprises a lip 62, which is located on the downstream end of the annular adapter 52 and projects radially inwardly toward the longitudinal axis 32 of the lower unit 10. On the opposite side of the upstream surface 58, the annular adapter 52 has a planar face 64.

As shown in FIGS. 4 and 5, the support ring 40 of the bearing carrier 36 comprises a circumferential groove 66, which is located just downstream of the upstream end 54 of the support ring 40. The groove 66 can be machined into the outwardly facing surface 72 of the bearing carrier 36 after the bearing carrier 36 is casted. The circumferential groove 66 is defined in the radially outwardly facing surface 72 of the support ring 40 and has a shallower upstream side 68 and a deeper downstream side 70. As shown in FIG. 6, this geometry allows the annular adapter 52 to be attached over the upstream end 54 of the support ring 40 with the radially inwardly projecting lip 62 seated within the circumferential groove 66 defined in the radially outwardly facing surface 72 of the support ring 40. The hooked geometry of the lip 62, seated within the circumferential groove 66, prevents the annular adapter 52 from falling off the support ring 40 while the bearing carrier 36 is installed in the bore 30 of the housing 14.

Figure 9:
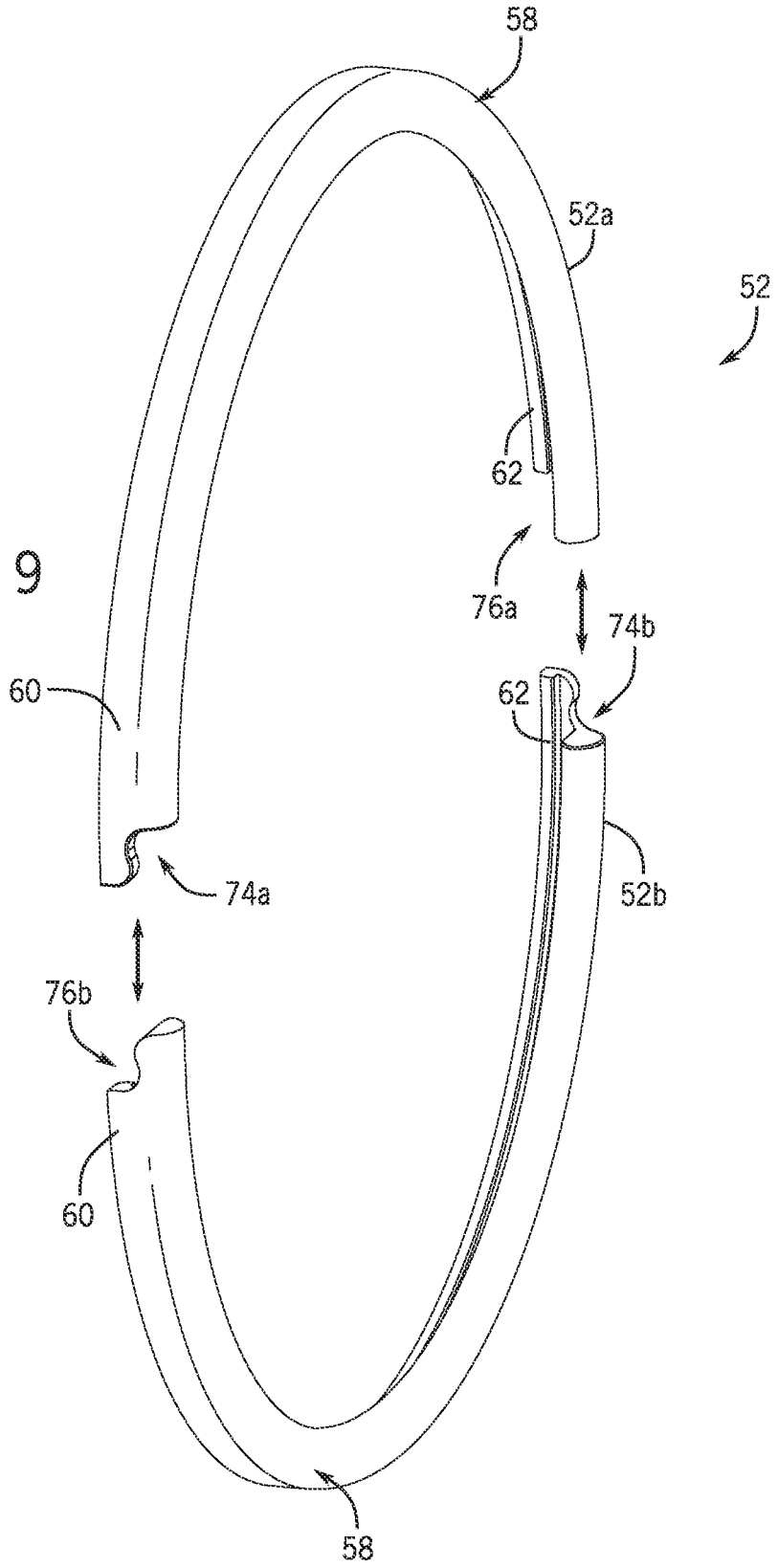
FIG. 9 shows first and second components of the adapter.

As noted, FIG. 4 only shows part of the annular adapter 52 installed on the bearing carrier 36. In the present example, the annular adapter 52 comprises two semi-annular components 52*a*, 52*b*, as shown in FIG. 9. The semi-annular components 52*a* and 52*b* are identical and thus the description of the component 52*a* shown in FIGS. 7 and 8 applies equally to the component 52*b* shown in FIG. 9. (In other examples, the two components are not identical, but rather include interlocking top and bottom parts.) The two components 52*a* and 52*b* are configured to be fit together, like pieces of a puzzle, such that they form a circle and cover an entirety of the upstream end 54 of the support ring 40. Note that the respective radial dimensions of the curved upstream surface 58 and the downstream planar face 64 of the components 52*a*, 52*b* of the annular adapter 52 are dimensioned so as to cover the entirety of the upstream end 54 of the support ring 40 in the radial direction as well, as shown in FIGS. 4 and 6.

Although the annular adapter 52 could be provided as a single piece, or as more than two pieces, the two components 52*a*, 52*b* case installation of the annular adapter 52 on the support ring 40. The components 52*a* and 52*b* can be placed with the lips 62 in the circumferential groove 66 on the support ring 40, the planar faces 64 adjacent the upstream end 54 of the support ring 40, and their ends 74*a,b* and 76*a,b* adjacent one another. Each component 52*a*, 52*b* has a first end 74*a* or 74*b* and a second end 76*a* or 76*b*. The flange 60 and lip 62 extend circumferentially further than the upstream surface 58 at each of the first ends 74*a,b*, while the upstream surface 58 extends circumferentially further than the flange 60 and the lip 62 at each of the second ends 76*a,b*. The ends 74*a,b* and 76*a,b* are shaped to fit together like pieces of a puzzle, joining the upstream surfaces 58 of each component 52*a*, 52*b* and the flanges 60 and lips 62 of each component 52*a*, 52*b*. Such an interlocking arrangement, with the second end 76*b* of one component 52*b* located upstream of the first end 74*a* of the other component 52*a*, and the second end 76*a* of the other component 52*a* upstream of the first end 74*b* of the component 52*b*, also helps to secure the components 52*a*, 52*b* to the support ring 40 (along with the lip 62 in the groove 66) prior to installation of the bearing carrier 36 in the bore 30 in the housing 14.

After both components 52*a*, 52*b* are attached to the upstream-facing surface 54 of the support ring 40, the bearing carrier 36 can be installed in the bore 30 in the housing 14. For example, referring to FIG. 3, the bearing carrier 36 can be installed through an open downstream end 76 of the bore 30 in the housing 14. When so installed, the flanges 60 of the components 52*a*. 52*b* of the annular adapter 52 are configured to be pressed or trapped between the radially outwardly facing surface 72 of the support ring 40 and the interior surface 42 of the central bore 30. Thus, the flange 60 is radially dimensioned to fill the space between the shallower upstream side 68 of the groove 66 in the support ring 40 and the interior surface 42 of the central bore 30. This ensures that a combined circumference of the annular adapter 52 installed in the groove 66 is equal to the outer circumference of the remainder of the outwardly facing surface 72 of the support ring 40 further downstream, thereby wedging the annular adapter 52 into the assembly and securing the annular adapter 52 against movement after being so installed.

After the bearing carrier 36 with the annular adapter 52 is installed in the bore 30, a thrust nut 82 can then be installed to maintain the entire assembly of the bearing carrier 36, gear set 18, propeller shaft 16, etc. within the central bore 30, as is conventional.

Figure 10:
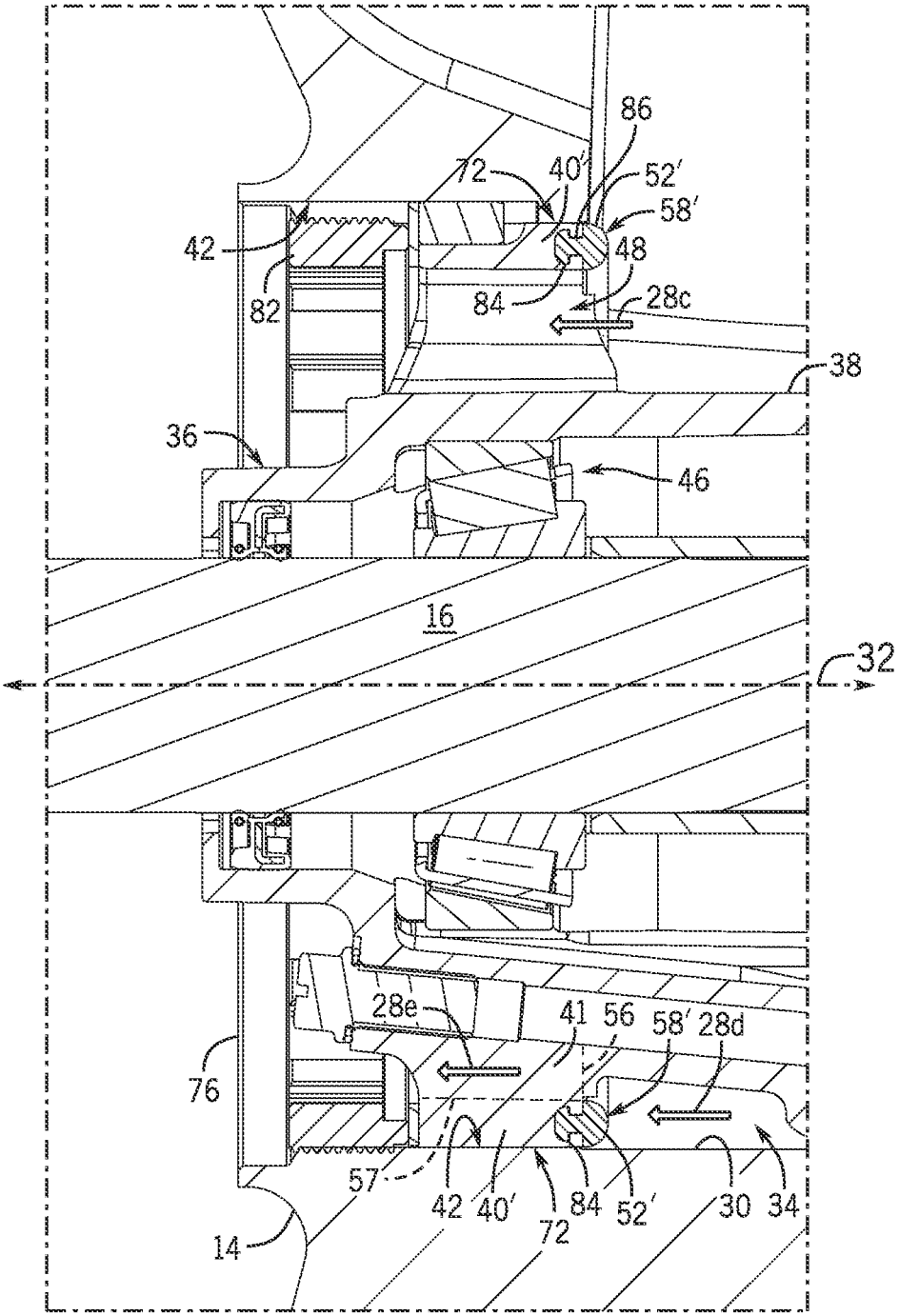
FIG. 10 is a cross section like that of FIG. 3, but showing alternative examples of the bearing carrier support ring and the adapter.

FIG. 10 shows an alternative embodiment, in which the components are generally the same as those in FIGS. 1-9, expect for the annular adapter 52' and the upstream end of the support ring 40'. Specifically, the upstream end of the support ring 40' includes a groove formed in the upstream end itself, rather than on the outer circumferential surface of the support ring as in the first embodiment. The groove has two undercuts that are configured to receive opposing projections 84 of the annular adapter 52'. The projections 84 are attached to the curved upstream surface 58' of the annular adapter by way of a leg 86, lending an overall mushroom-like shape to the adapter 52' when viewed in cross section. In another example, the downstream side of the adapter has a dovetail shape. The leg 86 and projections 84 can be made of a somewhat flexible material to allow them to be inserted within the groove in the upstream face of the support ring 40'. Alternatively, the annular adapter 52' could be over molded onto the upstream face of the support ring 40'.

Thus, the present disclosure is of a lower unit 10 for a marine propulsion device, the lower unit 10 comprising a housing 14 having a central bore 30 extending along a longitudinal axis 32. The central bore 30 at least partially defines an exhaust passageway 34 for travel of exhaust gas from upstream to downstream through the lower unit 10. A bearing carrier 36 is seated within the central bore 30 and the bearing carrier 36 further defines a portion of the exhaust passageway 34. A propeller shaft 16 extends along the longitudinal axis 32 and is coaxially supported within the bearing carrier 36. The lower unit 10 comprises an adapter 52, 52' having a convexly curved surface 58, 58' configured to cover an upstream-facing surface 54 of the bearing carrier 36 so as to smooth flow of the exhaust gas into the portion of the exhaust passageway 34 defined by the bearing carrier 36. In some examples, as shown in FIGS. 1-10, the convexly curved surface 58, 58' of the adapter 52, 52' is semicircular in cross-section.

The bearing carrier 36 comprises a main body 38 and a support ring 40, 40' spaced circumferentially outwardly from the main body 38 and seated against an interior surface 42 of the central bore 30. The portion of the exhaust passageway 34 is defined by a gap 48 between the main body 38 and the support ring 40, 40'. In one example, the upstream-facing surface of the bearing carrier 36 comprises an upstream end 54 of the support ring 40, 40'. In such an example, the adapter 52, 52' is an annular adapter, which may comprise two semi-annular components. The adapter 52, 52' is configured to cover an entirety of the upstream-facing surface 54 of the bearing carrier 36.

In one example, as shown in FIGS. 1-9, the bearing carrier 36 comprises a circumferential groove 66 and the annular adapter 52 comprises a lip 62 configured to be seated within the groove 66 in the bearing carrier 36. The groove 66 is located on a radially outwardly facing surface 72 of the bearing carrier 36 in the examples of FIGS. 1-9, but could instead be formed on the inwardly facing surface of the support ring 40.

In one example, as shown in FIGS. 1-9, the adapter comprises a flange 60 that is configured to be pressed or trapped between the radially outwardly facing surface 72 of the bearing carrier 36 and an interior surface 42 of the central bore 30. The adapter 52 further comprises a radially inwardly projecting lip 62 configured to be seated within the circumferential groove 66 defined in the radially outwardly facing surface 72 of the bearing carrier 36. The circumferential groove 66 has a shallower upstream side 68 and a deeper downstream side 70 and the flange 60 is dimensioned to fill a space between the shallower upstream side 68 of the groove 66 and the interior surface 42 of the central bore 30.

In another example, the adapter 52, 52' is also configured to cover the upstream surfaces of the ribs 41 that attach the support ring 40, 40' to the main body 38 of the bearing carrier 36. In such an example, the semi-annular portions of the adapter 52, 52' may be provided with fingers having rounded upstream surfaces that extend over the upstream ends of the ribs 41. Grooves may be provided on the ribs 41 to maintain the fingers of the adapter in place, or glue or mechanical fasteners may be used.

The adapter 52, 52' can be made of a polymer, composite, or metal. Nylon plastic may be preferable due to its ability to withstand heat, its ability to be formed in a desired shape, and its relatively flexibility during installation; however, stainless steel or aluminum could be used.

Although the present examples are shown with grooves formed in the support ring 40, 40' as the means by which the adapter 52, 52' is attached, additionally or alternatively, adhesive and/or mechanical fasteners such as screws could be used to attach the adapter 52, 52' to the support ring 40, 40'.

The adapter 52, 52' is able to be customized for a given application where a larger or smaller radius may be desired for the curved upstream surface 58, 58'. The remainder of the bearing carrier 36 can remain the same, while only the shape of the adapter 52, 52' changes. Thus, the present design allows for customization of the boundary surface at the upstream end of the support ring 40, 40' without the need to change casting molds. The adapter negates the need to cast a radius into the support ring or to hand grind or machine the support ring after casting.

In the above description, certain terms have been used for brevity, clarity, and understanding. No unnecessary limitations are to be inferred therefrom beyond the requirement of the prior art because such terms are used for descriptive purposes and are intended to be broadly construed. The order of method steps or decisions shown in the Figures and described herein are not limiting on the appended claims unless logic would dictate otherwise. It should be understood that the decisions and steps can be undertaken in any logical order and/or simultaneously. The different systems and methods described herein may be used alone or in combination with other systems and methods. It is to be expected that various equivalents, alternatives and modifications are possible within the scope of the appended claims.

What is claimed is:

1. A lower unit for a marine propulsion device, the lower unit comprising:

a housing having a central bore extending along a longitudinal axis, wherein the central bore at least partially defines an exhaust passageway for travel of exhaust gas from upstream to downstream through the lower unit;

a bearing carrier seated within the central bore, the bearing carrier comprising a main body and a support ring spaced circumferentially outwardly from the main body and seated against an interior surface of the central bore, wherein the exhaust passageway is further defined by a gap between the main body and the support ring, wherein the bearing carrier further defines a portion of the exhaust passageway;

a propeller shaft extending along the longitudinal axis and coaxially supported within the bearing carrier; and an adapter having a convexly curved surface attached to an upstream end of the support ring, the adapter being configured to smooth flow of the exhaust gas passing over the adapter and into the portion of the exhaust passageway defined by the bearing carrier.

2. The lower unit of claim 1, wherein the support ring comprises a circumferential groove and the adapter comprises a lip configured to be seated within the groove.

3. The lower unit of claim 2, wherein the groove is located on a radially outwardly facing surface of the support ring.

4. The lower unit of claim 1, wherein the adapter comprises a a flange configured to be pressed or trapped between a radially outwardly facing surface of the support ring and the interior surface of the central bore, and a radially inwardly projecting lip configured to be seated within a circumferential groove defined in the radially outwardly facing surface of the support ring.

5. The lower unit of claim 4, wherein the circumferential groove has a shallower upstream side and a deeper downstream side, and wherein the flange is dimensioned to fill a space between the shallower upstream side of the groove and the interior surface of the central bore.

6. A lower unit for a marine propulsion device, the lower unit comprising:

a housing having a central bore extending along a longitudinal axis, wherein the central bore at least partially defines an exhaust passageway for travel of exhaust gas from upstream to downstream through the lower unit;

a bearing carrier seated within the central bore, wherein the bearing carrier further defines a portion of the exhaust passageway;

a propeller shaft extending along the longitudinal axis and coaxially supported within the bearing carrier; and an adapter having a convexly curved surface configured to cover an upstream-facing surface of the bearing carrier so as to smooth flow of the exhaust gas into the portion of the exhaust passageway defined by the bearing carrier.

7. The lower unit of claim 6, wherein the adapter is an annular adapter, the bearing carrier comprises a circumferential groove, and the annular adapter comprises a lip configured to be seated within the groove in the bearing carrier.

8. The lower unit of claim 7, wherein the groove is located on a radially outwardly facing surface of the bearing carrier.

9. The lower unit of claim 6, wherein the adapter comprises a flange that is configured to be pressed or trapped between a radially outwardly facing surface of the bearing carrier and an interior surface of the central bore.

10. The lower unit of claim 9, wherein the adapter further comprises a radially inwardly projecting lip configured to be seated within a circumferential groove defined in the radially outwardly facing surface of the bearing carrier.

11. The lower unit of claim 10, wherein the circumferential groove has a shallower upstream side and a deeper downstream side, and wherein the flange is dimensioned to fill a space between the shallower upstream side of the groove and the interior surface of the central bore.

12. The lower unit of claim 6, wherein the convexly curved surface of the adapter is semicircular in cross-section.

13. The lower unit of claim 6, wherein the adapter comprises two semi-annular components.

14. The lower unit of claim 6, wherein the adapter is configured to cover an entirety of the upstream-facing surface of the bearing carrier.

15. The lower unit of claim 6, wherein the bearing carrier comprises a main body and a support ring spaced circumferentially outwardly from the main body and seated against an interior surface of the central bore, wherein the portion of the exhaust passageway is defined by a gap between the main body and the support ring, and wherein the upstream-facing surface of the bearing carrier comprises an upstream end of the support ring.

16. The lower unit of claim 15, wherein the gap is configured to allow the exhaust gas to flow therethrough from upstream to downstream.

17. The lower unit of claim 16, wherein the adapter is configured to smooth flow of the exhaust gas passing over the adapter and into the gap between the main body and the support ring.

18. The lower unit of claim 15, wherein the support ring comprises a circumferential groove and the adapter comprises a lip configured to be seated within the groove.

19. The lower unit of claim 18, wherein the groove is located on a radially outwardly facing surface of the support ring.

* * * * *